United States Patent [19]

Tani et al.

[11] 4,217,052

[45] Aug. 12, 1980

[54] METHOD FOR EFFECTING REGISTRATION FOR A COPYING APPARATUS

[75] Inventors: Tatsuo Tani, Tokyo; Masao Kono, Yokohama, both of Japan

[73] Assignee: Ricoh Company, Ltd., Japan

[21] Appl. No.: 877,818

[22] Filed: Feb. 14, 1978

[30] Foreign Application Priority Data

| | | | |
|---|---|---|---|
| Feb. 15, 1977 | [JP] | Japan | 52/14559 |
| Feb. 16, 1977 | [JP] | Japan | 52/15068 |
| Apr. 4, 1977 | [JP] | Japan | 52/37567 |
| Apr. 4, 1977 | [JP] | Japan | 52/37568 |

[51] Int. Cl.[2] ..... G03G 15/00

[52] U.S. Cl. ..... 355/8; 355/14 R; 355/55; 355/77

[58] Field of Search ..... 355/3 SH, 8 SH, 14, 355/16, 55-60, 77; 96/1 R

[56] References Cited

U.S. PATENT DOCUMENTS

| | | | |
|---|---|---|---|
| 3,834,805 | 9/1974 | Pichierri | 355/8 |
| 4,007,986 | 2/1977 | Komori et al. | 355/60 X |
| 4,033,691 | 7/1977 | Bierworth et al. | 355/57 X |
| 4,080,062 | 3/1978 | Torigai et al | 355/57 X |
| 4,126,389 | 11/1978 | Ikeda et al. | 355/8 X |

*Primary Examiner*—R. L. Moses

*Attorney, Agent, or Firm*—McGlew and Tuttle

[57] ABSTRACT

In copying apparatus having a magnification ratio varying device, wherein a photosensitive member in motion is exposed to an optical image of an original by slit exposing to form an electrostatic latent image thereon and the original scanning velocity is varied in accordance with the magnification ratio selected, it is necessary to effect registration of the forward end of the image of an original with the leading end of a photosensitive sheet or a transfer-printing sheet.

The above-mentioned registration is effected by delivering a copy sheet simultaneously as or after lapse of a predetermined time following the production of a detection signal by a detection means, which detecting position is varied in accordance with the magnification ratio selected.

17 Claims, 13 Drawing Figures

METHOD FOR EFFECTING REGISTRATION FOR A COPYING APPARATUS

BACKGROUND OF THE INVENTION

This invention relates to a method for effecting registration for a copying apparatus having a magnification ratio varying device, wherein a photosensitive member in motion is exposed to an optical image of an original by slit exposing to form an electrostatic latent image thereon, by varying the original scanning velocity in accordance with the magnification ratio selected.

Nowadays electrophotographic copying apparatus equipped with magnification ratio varying devices are becoming popular. The term "magnification ratio" as used herein refers to the ratio of the size of a duplicate produced from an original by electrophotographic copying to that of the original. For example, when the magnification ratio is $1:\sqrt{2}$ a duplicate will have a size which is twice as large as that of its original; when it is 1:1, a duplicate will be equal in size to its original; and when it is $1:1/\sqrt{2}$ a duplicate will have a size which is one half as large as that of its original. In copying apparatus of the aforementioned type, it is necessary to effect registration of the forward end of the image of an original which is projected by a light on the photosensitive member or of the image of an original formed on the photosensitive member with the leading end of a photosensitive sheet or a transfer-printing sheet which is in motion, when copying of the original is carried out. Particularly when restriction is placed on the position in which an electrostatic latent image is formed on the photosensitive member, such as when the photosensitive member is in the form of a drum and has a photosensitive sheet with a gap wound on its periphery. In this case it is essential that copying be performed by synchronizing the movement of the photosensitive member with the operation of exposing the photosensitive member to an optical image of an original and by bringing the forward end of an image formed on the photosensitive member into registration or correlation with the leading edge of a transfer-printing sheet which is delivered to the transfer-printing position, in case a copying apparatus of the aforesaid type having a magnification ratio varying device is used. A change in the magnification ratio by means of a magnification ratio varying device makes it necessary to change the travelling speed of the photosensitive member or the original scanning speed. However, the structural arrangement of a copying apparatus makes it difficult to change the speed at which the photosensitive member travels. Thus it is usual practice to change the original scanning speed in accordance with a change in the magnification ratio.

A change in the original scanning speed which is necessitated by a change in the magnification ratio may cause mismatching in place of the forward end of the image of an original on the photosensitive member and the leading end of a copy sheet.

SUMMARY OF THE INVENTION

This invention has as its object the provision of a method for effecting registration which enables the magnification ratio to be varied without causing the aforementioned mismatching in producing a copy from an original by means of electrophotograhic copying.

The aforementioned object is accomplished by the provision of steps of providing first detection means for detecting the leading end of the original in a path of travel of the original or a path of travel of a movable optical system, said first detection means having its detecting position varied in accordance with the magnification ratio selected, and delivering a copy sheet simultaneously as or after lapse of a predetermined time following the production of a detection signal by said first detection means. Other features and advantages of the invention will become apparent from the following description of embodiments of the invention, together with the accompanying drawings.

BRIEF DESCRIPTION OF THE DRAWINGS

The problems encountered with regard to changing the magnification ratio and embodiments of the invention which provide a solution to each of these problems will now be described by referring the accompanying drawings, in which.

DESCRIPTION OF THE PREFERRED EMBODIMENTS

Figure 1:
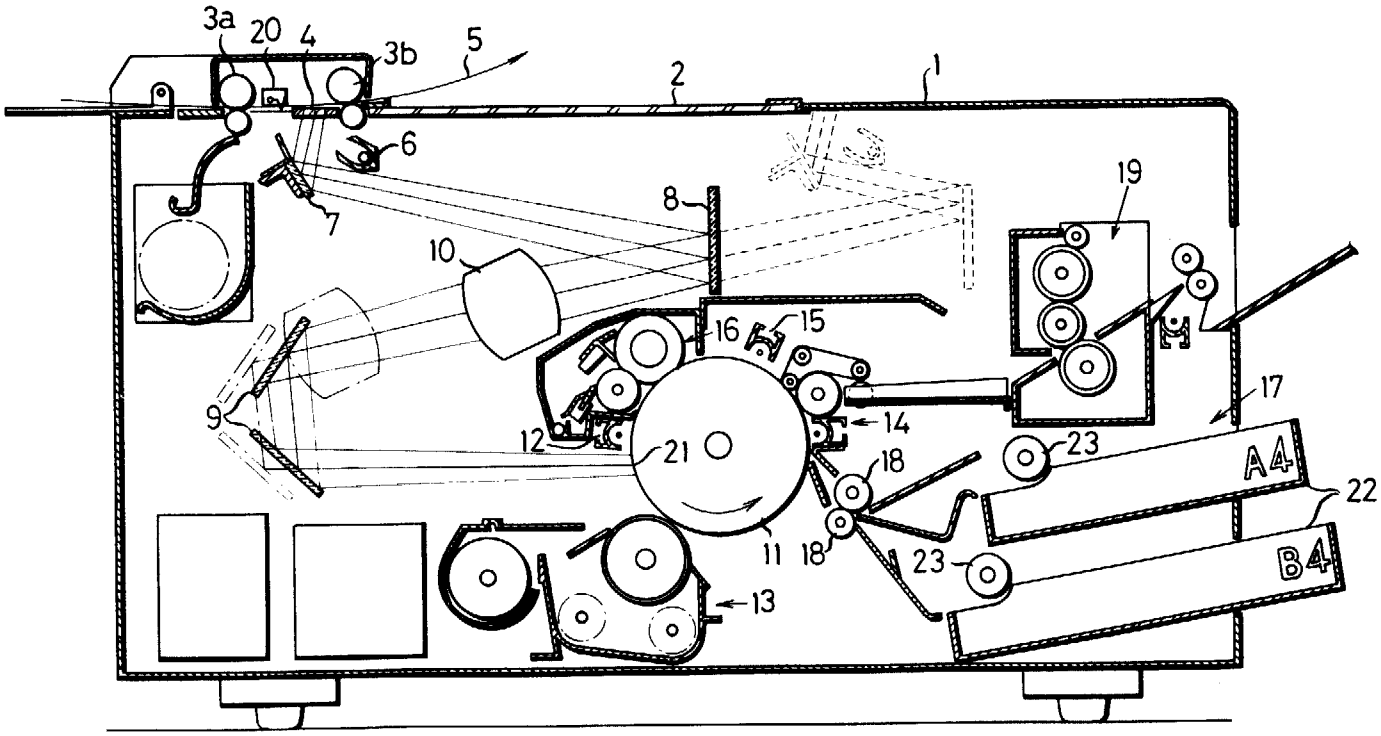
FIG. 1 is a schematic view of a copying apparatus which is suitable for carrying out the method according to the present invention.

Preferred embodiments of the invention will now be described by referring to the accompanying drawings. In FIG. 1, there is shown an electrophotographic copying apparatus comprising a casing 1, a large thickness original or a book type original placing transparent glass plate 2 in a top wall of the casing 1, small thickness original or sheet original feed means 3*a*, 3*b* in the top wall of the casing 1, and an original exposing slit 4 mounted in the sheet original feed means 3*a*, 3*b*. In this apparatus, a sheet original 5 is fed either manually or by means of an automatic original feed device (not shown) in the direction of the arrow. Mounted within the casing 1 is an exposing device comprising a light source 6, mirrors 7, 8 and 9 and a lens system 10. When a large thickness original is placed on the original placing glass plate and copied, the light source 6 and mirrors 7 and 8 are moved to scan the original. The lens system 10 and mirror 9 can be moved between their solid line positions and dash-and-dot line positions for changing the magnification ratio.

A photosensitive means in the form of a drum 11 is mounted within the casing 1 for rotation in the direction of the arrow, and an electrical charging device 12, an exposing position 21, a developing device 13, a transfer-printing device 14, an electric charge removing device 15 and a cleaning device 16 are located around the photosensitive drum 11, in a well known manner. There are also provided a sheet feed device 17, a pair of register rollers 18 and a fixing device 19. The sheet feed device 17 includes two cassettes 22, 22 for placing sheets of two different sizes therein. A sheet feed roller 23 is mounted above each cassette 22. These devices are known and their detailed constructions will not be described here.

The aforementioned copying apparatus includes a detection switch 20 for detecting the leading end of an original, which is located in the path of travel of the original. Difficulties are encountered in mounting the detection switch 20 in the original exposing slit 4. In view of the need to produce a registration signal for a transfer-printing sheet in good timing with respect to the detection of the original, the detection switch 20 is mounted anterior to the exposing slit 4. This arrangement is shown in detail in FIG. 2.

Figure 2:
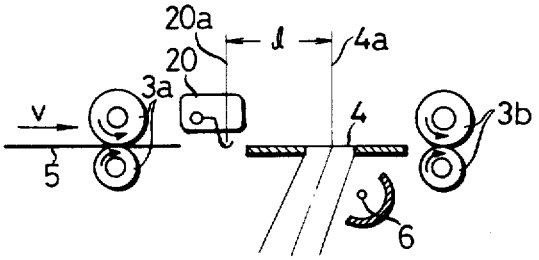
FIG. 2 is a schematic view showing the width of the slit for exposing a original sheet.

In FIG. 2, the sheet original 5 fed by means of the pair of feed rollers 3*a*, 3*a* has its leading end detected by the detection switch 20, then is illuminated through the exposing slit 4 by means of a light emanating from the light source 6 and is finally discharged by means of the pair of feed rollers 3*b*, 3*b*. In this case, the velocity of travel of the original 5 at a standard magnification ratio $m_1$ (1:1, for example) is denoted by v, and the distance between a detecting position 20*a* of the detection switch 20 and a standard position 4*a* of the exposing slit 4 is denoted by l. The standard position 4*a* of the exposing slit 4 refers to the position of a light ray of all the light rays in the light path connecting the original exposing slit 4 with a slit in an image forming section of a photosensitive member which position never changes and remains intact even if the lens and mirrors are moved and the slits show a change in their width, when the magnification ratio is varied. Assuming that it takes the original a time t to cover the distance l in its movement, the following relation holds:

$$t = l/v$$

If the magnification ratio $m_1$ is constant, the original travel velocity will be constant and there will be no change in the value of t. After lapse of the time t following the detection of the leading end of the original 5 by the detection switch 20, the leading end of the original 5 is illuminated, and an electrostatic latent image is formed on the surface of the photosentive drum 11 in the exposing position 21 through the slit in the image forming section. The electrostatic latent image is then developed by the developing device 13 into a visible image and travels to a transfer-printing position. At this time, a transfer-printing sheet fed from any one of the cassettes 22 by means of the associated feed roller 23 abuts against the nip of register rollers 18, 18, which remain stationary and stands by. The register rollers 18, 18 begin rotating after lapse of a time Tc following the detection of the leading end of the original 5 by the detection switch 20, to deliver the same for effecting registration so that the transfer-printing sheet is superposed on the visible image on the photosensitive drum 11 which has just reached the transfer-printing position. Thus the transfer-printing sheet having the visible image thereon passes the transfer-printing position. The time Tc is selected such that the visible image on the photosensitive drum 11 and the transfer-printing sheet delivered by the register rollers 18, 18 are brought into registration with each other.

Figure 3:
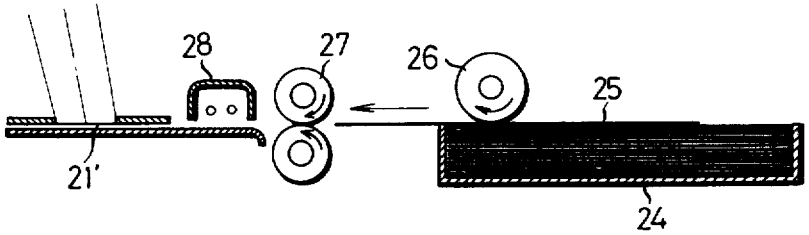
FIG. 3 is a schematic view showing the width of the slit in the image forming section of a direct copying apparatus using photosensitive sheets.

In the direct-type copying apparatus shown in FIG. 3, a plurality of means in the form of photosensitive copy sheets 25 are arranged in vertically stacked relation in a cassette 24, and the uppermost sheet is fed by means of a feed roller 26 and brought to a position in which it abuts against the nip of register rollers 27, 27 which remain stationary, so that the photosensitive sheet stands by. As aforesaid, the register rollers 27, 27 begin to rotate after lapse of the time Tc allowing the detection of the leading end of the original 5 by the detection switch 20, so that the photosensitive sheet standing by is delivered for effecting registration by the register rollers 27, 27 to a position in which it is electrically charged by an electrical charging device 28. Then, the photosensitive sheet reaches a slit 21′ of the image forming section which is disposed in an exposing position, where the photosensitive sheet is exposed to an optical image of the original projected through the exposing slit 4 at this time, so that an electrostatic latent image is formed on the photosensitive sheet.

In the copying apparatus of the type described above, if the standard magnification ratio $m_1$ is varied while the feed velocity of the photosensitive sheet remains constant, the original travel velocity must be changed. The original travel velocity is distinctly determined by the selected magnification ratio. Assuming that the standard magnification ratio $m_1$ is varied to $m_2$ and $m_3$, the original travel velocity will change from v to the following:

$$(m1/m2)v,\ (m1/m3)v$$

Therefore, if the times required for the original to reach the standard position of the slit from the detected position are denoted by t1, t2 and t3 for the magnification ratios m1, m2 and m3 respectively, the following relations hold:

$$t1 = l/v \quad (1)$$

$$t2 = (m2/m1)(l/v) \quad (2)$$

$$t3 = (m3/m1)(l/v) \quad (3)$$

Thus the value of t1, t2 and t3 differ from one another. Therefore, if the aforementioned method is used wherein the position in which the leading end of the original detected is fixed and a photosensitive sheet or transfer-printing sheet is delivered by the register rollers after lapse of a predetermined time following detection of the leading end of the original, mismatching in the placement of the original and photosensitive sheet or transfer-printing sheet will occur when the magnification ratio is varied.

The aforesaid mismatching can be avoided if the leading end of an original reaches the standard position of the exposing slit after lapse of a constant time following the detection of the leading end of the original by the detection switch, no matter what the magnification ratio may be. Based on this concept, the value of the distance l is varied in such a manner that $t1=t2=t3=t0$ (constant) according to the invention. If the distance between the position in which the leading end of the original is detected and the standard position of the exposing slit are denoted by l1, l2 and l3 for the magnification ratio m1, m2 and m3 respectively, the following relations can be established:

$$l1=vt_0$$
(from equation 1)

$$l2=(m1/m2)vt_0$$
(from equation 2)

$$l3=(m1/m3)vt_0$$
(from equation 3)

This means that the aforesaid mismatching can be avoided if the leading end of the original is detected in positions in which the value of the distance between the position in which the leading end of the original is detected and the standard position of the exposing slit are l1, l2 and l3 for the magnification ratios m1, m2 and m3 respectively.

Figure 4:
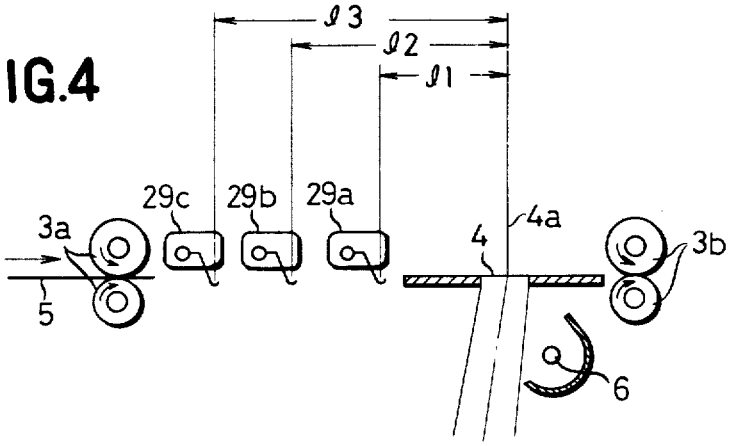
FIG. 4 is a schematic view in explanation of a first embodiment of the method in conformity with the invention.

In FIG. 4. detection switches 29a, 29b and 29c are located in positions anterior to the exposing slit 4 and spaced from the standard position 4a thereof by distance l1, l2 and l3 respectively. One of the switches 29a, 29b and 29c is operated depending on the magnification ratio selected, with the rest of the switches remaining nonoperative.

Figure 5:
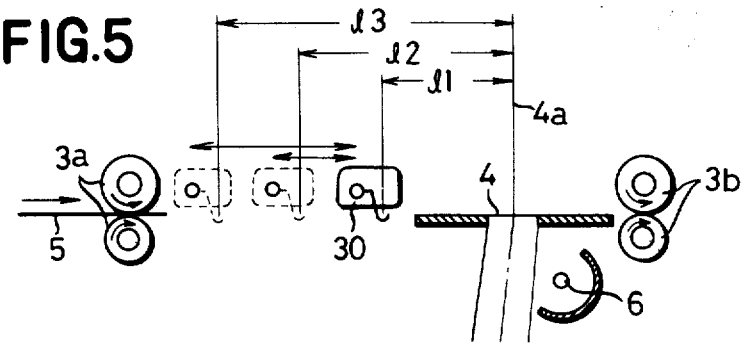
FIG. 5 is a schematic view in explanation of a modification of the first embodiment.

In FIG. 5, a single detection switch 30 is movably arranged in the path of travel of the original, and moved to a position which corresponds to the magnification ratio selected.

Figure 6:
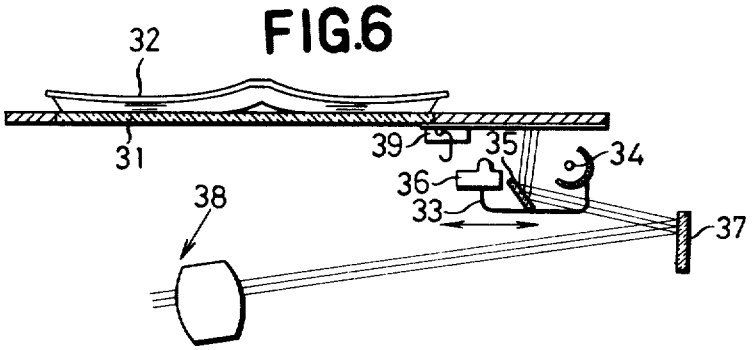
FIG. 6 is a schematic view showing the application of the first embodiment in a copying apparatus of the type in which the optical system is moved.
Figure 7:
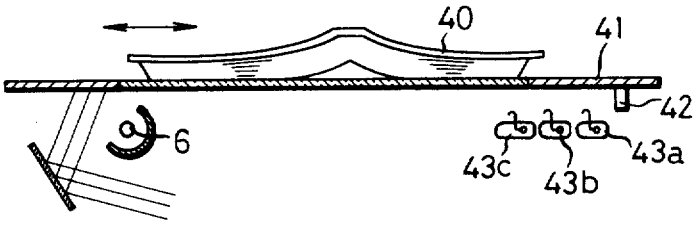
FIG. 7 is a schematic view showing the application of the first embodiment in a copying apparatus of the type in which the original placing table is moved.

As aforesaid, the method according to the invention can be advantageously carried into practice not only with a copying apparatus of the sheet original moving system but also with a copying apparatus of the original placing table moving system or the optical system moving system. FIGS. 6 and 7 show examples in which the first embodiment of the invention is applied to a copying apparatus of the optical system moving system and a copying apparatus of the original placing table moving system respectively.

In FIG. 6, a large thickness original 32 is placed on an original placing glass plate 31, and a movable optical system 33 is mounted for scanning the original 32. The movable system 33 includes a light source 34, a reflector 35, an operating member 36, and a reflector 37. The light source 34, reflector 35 and operating member 36 are secured together as a unit to move at the same speed, while the reflector 37 moves at a speed half that of the other members of the optical system 33. The numeral 38 designates a magnification ratio varying optical system. A detection switch 39 is mounted on the underside of a top wall of the casing along the path of travel of the movable optical system 33 and is adapted to be actuated by the operating member 36 when the optical system 33 moves in its path of travel to produce an original leading end detection signal. The detection switch 39, like the detection switch 30 shown in FIG. 5, is capable of moving along the path of travel of the optical system 33 and being temporarily fixed in place in one of a plurality of predetermined positions depending on the magnification ratio selected. Alternatively, a plurality of detection switches may be fixedly mounted in suitable positions and one of the switches may be operated depending on the selected magnification ratio, like the detection switches 29a, 29b and 29c shown in FIG. 4.

In FIG. 7, an original placing table 31 which movably mounted and supports an original 40 thereon has attached to its underside an operating projection 42, and three detection switches 43a, 43b and 43c are arranged in the direction of travel of the table 41 and in spaced juxtaposed relation to the underside of the table 41 in positions in which the switches can be operated by the operating projection 42. One of the switches is selectively operated by the operating projection 42 depending on the magnification ratio selected. Alternatively, only one detection switch may be provided and moved to one of a plurality of predetermined positions depending on the magnification ratio selected, as described with reference to FIG. 5. Upon actuation of one of the switches 43a, 43b and 43c, the actuated switch produces a signal which causes rotation of the register rollers 18, 18 or 27, 27 to deliver the transfer-printing sheet or photosensitive sheet which is standing by to the transfer-printing position for effecting registration or exposing position.

It will be appreciated that the method according to the invention ensures registration or matching in place of the forward end of the image of the original and the leading end of the copy sheet, even if the original scanning velocity changes when the magnification ratio is varied.

In the first embodiment described hereinabove, one detection means is relied on to effect lighting of the light source, passing of a current to the electrically charging device, and feeding and delivery of a copy sheet in good timing. The feeding of the copy sheet especially must be completed prior to initiation of the delivery thereof to the transfer-printing position or exposing position in such a manner that registration can be effected. To this end, the detection means must be located in the original travelling path in a position which is a considerable distance upstream of the original exposing slit. An increase in the distance between the detection means and the exposing slit results in an increased possibility of mismatching in placement of the forward end of the image of an original projected on the photosensitive member or of the image of an original formed on the photosensitive member and the leading end of a photosensitive sheet or a transfer-printing sheet. This places burdens on the detection means and registration may not be effected with a high degree of precision. Registration can be effected with increased precision by using a second embodiment of the invention which will now be described.

Figure 8:
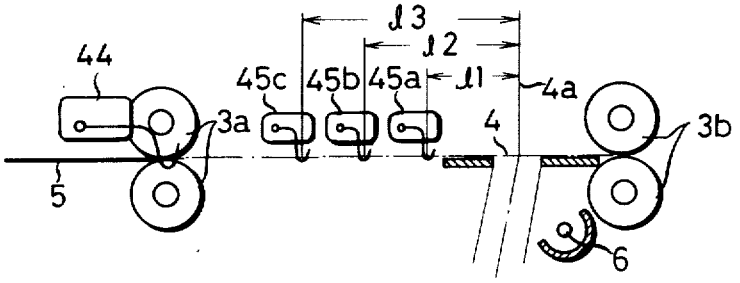
FIG. 8 is a schematic view in explanation of a second embodiment of the method in conformity with the invention.

In FIG. 8, an original insertion detection switch 44 (second detection switch means) is mounted in the path of travel of the original in a position which is upstream of the original slit 4 by a considerable distance, and three original leading end detection switches 45a, 45b and 45c (first detection switch means) are located downstream of the detection switch 44 and upstream of the original exposing slit 4. The detection switch 44 produces an original insertion detection signal which causes lighting of the light source 6, passing of a current to the electrically charging device 12 and initiation of rotation of one of the feed rollers 23 for feeding a sheet from one of the cassettes 22. One of the switches 45 of the first detection switch means is selected by a magnification ratio selecting circuit in accordance with the magnification ratio selected, and produces an original leading end detection signal. Simultaneously as the original leading end detection signal is produced or after lapse of a predetermined time Tc following the production of such signal, a copy sheet delivery signal is produced.

Figure 9:
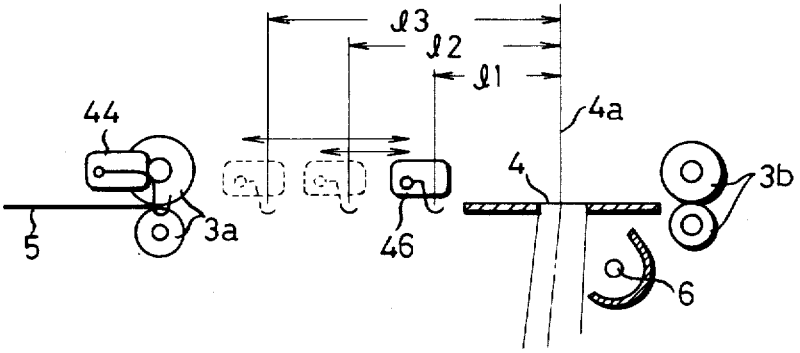
FIG. 9 is a schematic view in explanation of a modification of the second embodiment.

In a modification of the second embodiment shown in FIG. 9, a signal switch 46 for detecting the leading end of an original is movably arranged in the path of the original and can be moved to a position corresponding to the magnification ratio selected.

Figure 10:
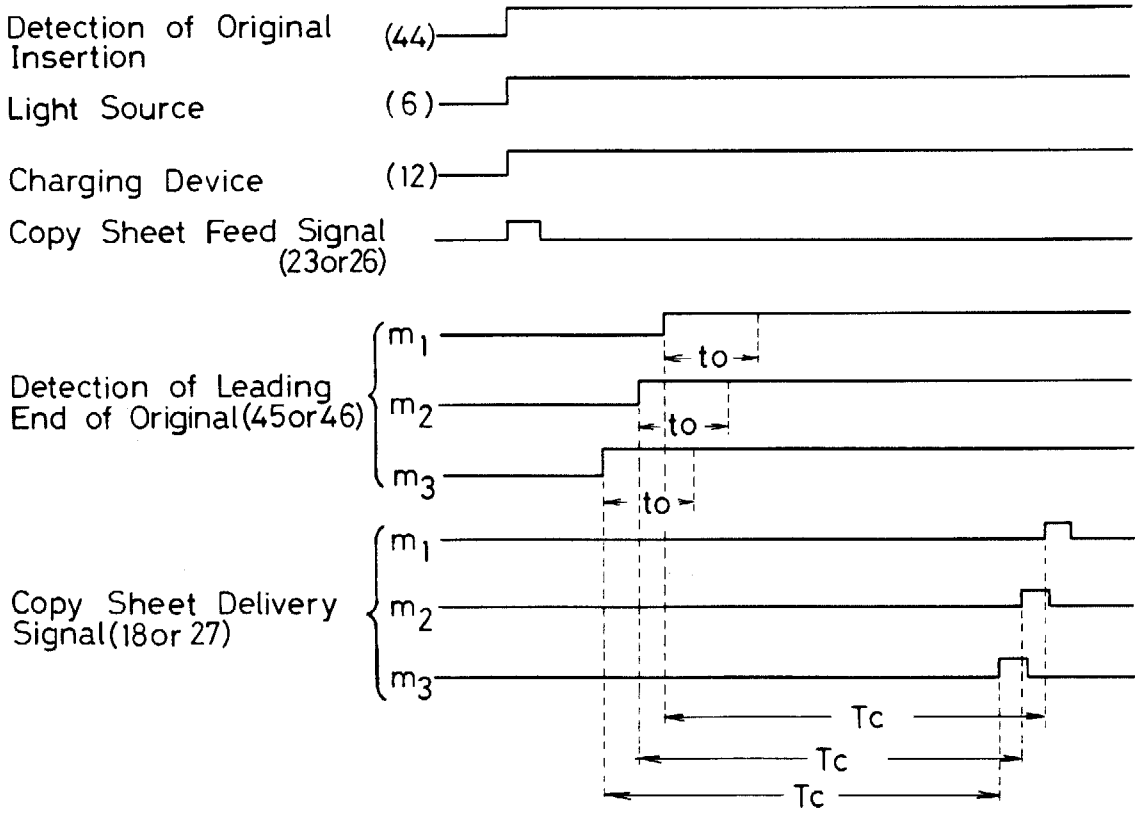
FIG. 10 is a time chart showing the operation of various devices and the production of signals taking place in chronological sequence when the second embodiment is carried into practice.

In the time chart shown in FIG. 10, operation of various devices and production of signals taking place in chronological sequence are indicated. When the original insertion detection switch 44 (second detection means) detects the insertion of an original, a current is passed to the light source 6 and electrical charging device 12. At the same time, a copy sheet feed signal is produced which causes the feed roller 23 (26) to rotate. Then, after lapse of a predetermined time following the production of an original leading end detection signal by the selected one of the original leading end detection switches (first detection means) 45a, 45b and 45c or 46, the leading end of the original reaches the standard position 4a of the exposing slit 4. Thereafter, after lapse of another predetermined time Tc following the production of the original leading end detection signal, a copy sheet delivery signal is produced to cause the register rollers 18, 18 or 27, 27 rotate and deliver the copy sheet into its standby position.

In the event that there is still not sufficiently long time between the feeding of the copy sheet and the delivery thereof even if the aforesaid process is adopted, the movement of the original may be temporarily interrupted after the insertion of the original is detected by the original insertion detection switch (second detection means). Any position may be selected for interrupting the travel of the original, so long as such position is anterior to the original leading end detection switch (first detection means) and the exposing slit. Since the interruption of the travel of the original occurs prior to the production of the original leading end detection signal by the original leading end detection switch (first detection means) which is used as a reference for the production of a copy sheet delivery signal, such interruption of the travel of the original causes no error in effecting registration.

In the second embodiment shown in FIG. 8 and its modification shown in FIG. 9, the first detection means is located upstream of the exposing slit 4. It is to be understood that the first detection means may be located downstream of the exposing slit 4. Particularly, if the first detection means is mounted in a position in which it produces an original leading end detection signal that can be used as a copy sheet delivery signal, the need to provide a device for producing the sheet delivery signal following the production of the leading end detection signal, such as a timer circuit or cam means for causing a delay of a predetermined time, can be eliminated. Thus, the construction can be simplified and registration can be effected with a high degree of precision.

Like the first embodiment, the aforementioned second embodiment can be advantageously carried into practice by using a copying apparatus of the original placing table moving system or of the optical system moving system.

Figure 11:
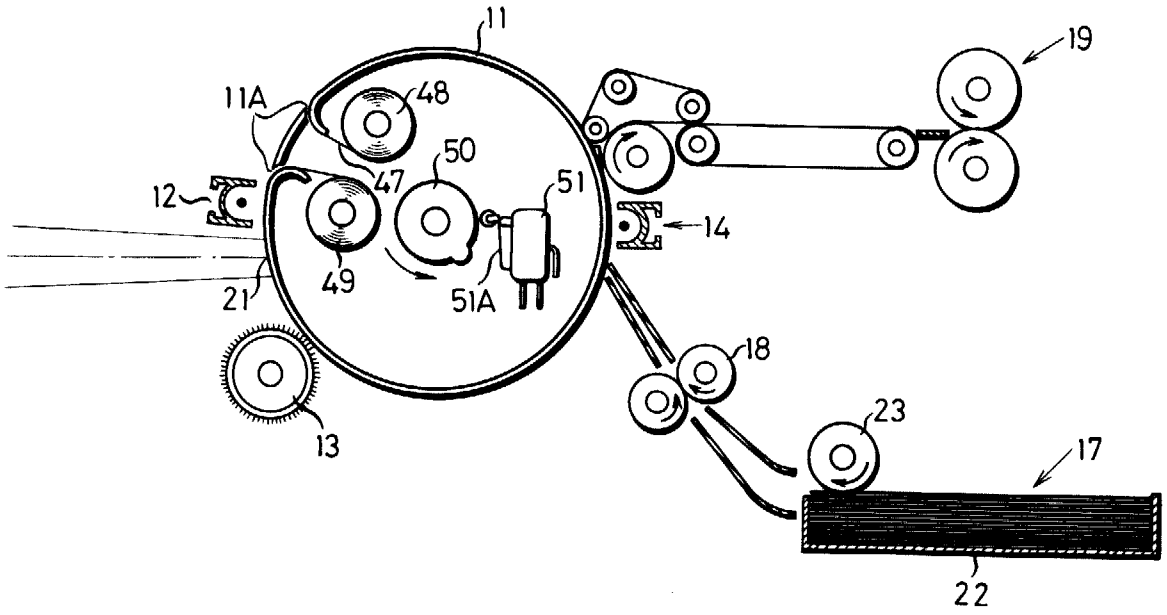
FIG. 11 is a fragmentary schematic view of a copying apparatus including a photosensitive drum provided with a photosensitive strip having a gap in a portion thereof which is wound on the drum, and adapted to a third embodiment of the method in conformity with the invention.

The present invention can have application in a copying apparatus having a photosensitive drum provided with a photosensitive strip having a gap in a portion thereof which is wound on the drum as shown in FIG. 11. A third embodiment of the invention will now be described.

In FIG. 11, a photosensitive strip 47 is wound on the outer periphery of the photosensitive drum 11 and extends, through a slit 11A formed longitudinally of the drum 11, into the interior of the drum 11 where both ends of the photosensitive strip 47 are wound on a take-up spool 48 and a pay-out spool 49 respectively. By paying out a required length of the photosensitive strip 47 from the pay-out spool 49 and winding the strip 47 on the take-up spool 48, it is possible to replace the old portion of the photosensitive strip 47 on the outer periphery of the photosensitive drum 11 by a new portion thereof. The photosensitive drum 11 is supported for rotation by a shaft which also supports a cam 50 having a projection in its periphery which is adapted to be contacted by an actuator 51A of a stationary detection switch 51. As the projection of the cam 50 is contacted by the actuator 51A having a roller, the slit 11A of the photosensitive drum 11 or the gap in the portion of the photosensitive strip 47 wound on the drum 11 can be detected. Cam 50 with switch 51 comprise a further detection means.

In the copying apparatus including the aforementioned photosensitive drum 11, an original inserted in the original feed means 3a, 3b and fed thereby temporarily stops its movement when its leading end strikes one of the original leading end detecting switches 29a, 29b and 29c shown in FIG. 4, for example, that has been selected in accordance with the magnification ratio selected. Then the reference position (slit 11A) of the rotating drum 11 is detected by a detection switch 51 which produces a detection signal. After lapse of a predetermined time following the production of the reference position detection signal, a transfer-printing sheet is delivered for registration. Meanwhile the original which has been temporarily rendered stationary is moved again after lapse of another predetermined time following the production of the reference position detection signal so that an exposing operation can be carried out. Each of the aforementioned predetermined times includes zero, and this means that delivery of the transfer-printing sheet or restarting of the travel of the original may be effected simultaneously as the production of the signal. The time required for the original to pass the standard position 4a of the original exposing slit 4 after starting its travel again is constant, regardless of a change in the magnification ratio. The interruption of the travel of the original may be effected by means of the detection switch 30 shown in FIG. 5 which moves its position in accordance with the magnification ratio selected.

Figure 12:
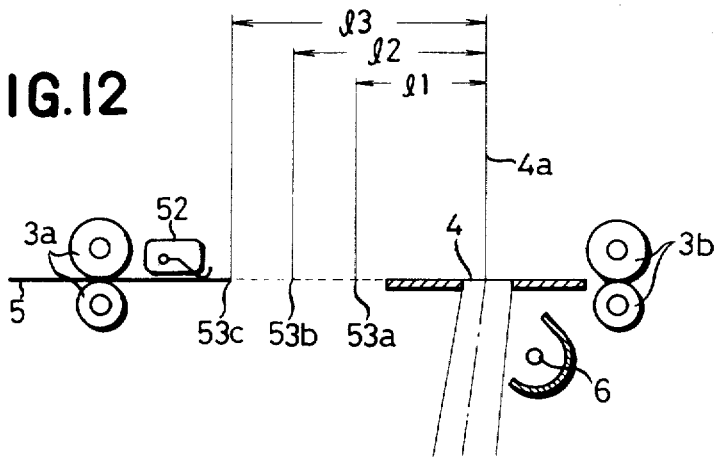
FIG. 12 is schematic view in explanation of a modification of the third embodiment of the method in conformity with the invention.

In a modification of the third embodiment shown in FIG. 12, the leading end of an original is detected by a detection switch 52, and the travel of the original is interrupted after lapse of a time which may vary depending on the magnification ratio selected following the detection of the leading end by the switch 52. As a result, the original stops in a position such that its leading end is disposed at 53*a*, 53*b* or 53*c* depending on the magnification ratio selected. The positions 53*a*, 53*b* and 53*c* are spaced apart by distances l1, l2 and l3 respectively from the standard position 4*a* of the exposing slit 4. As is well known to one of ordinary skill in the art, the original can be stopped in this way by using a known circuit means.

Figure 13:
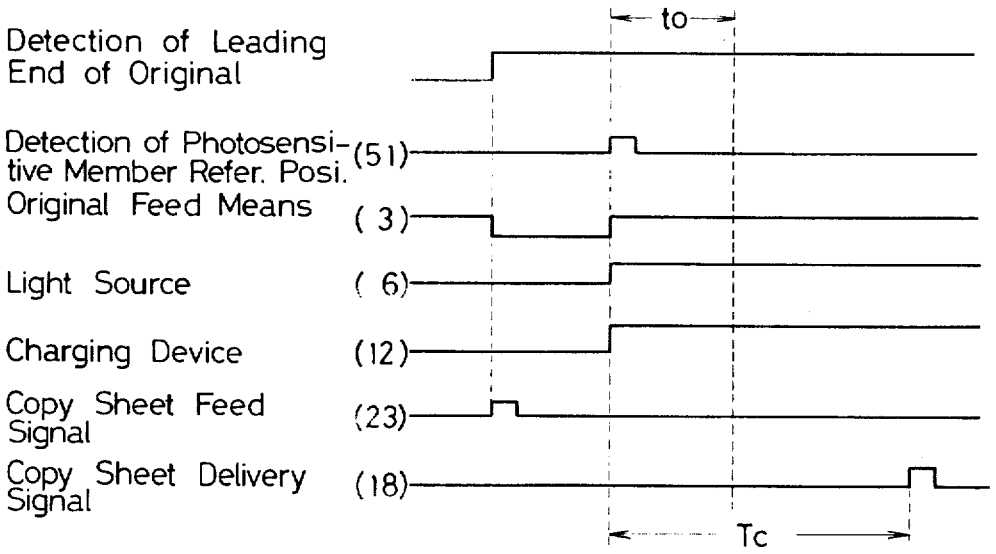
FIG. 13 is a time chart showing the operation of various devices performed in chronological sequence when the third embodiment of the method in conformity with the invention is carried into practice.

FIG. 13 shows a time chart in which the original feed means 3*a*, 3*b* is rendered inoperative when the original leading end detection switch detects the leading end of the original 5. In the modification of the third embodiment shown in FIG. 12, interruption of the travel of the originals lags behind the production of a detection signal by the original leading end detection switch. At the same time, the feed roller 23 is actuated to feed a transfer-printing sheet which is brought into abutment against the register rollers 18, 18 and remains in a standby position. It is to be understood that actuation of the feed roller 23 need not be effected by the original leading end detection signal. What is essential is that a transfer-printing sheet reaches the register rollers 18, 18 prior to actuation of the register rollers 18, 18. Then the detection switch 51 detects the reference position of the photosensitive member and produces a detection signal which is used to pass a current to the light source 6 and electrical charging device 12. At the same time, the original feed means 3*a*, 3*b* is rendered operative again to restart the original 5 in its travel. The leading end of the original 5 reaches the exposing slit 4 after lapse of the predetermined time $t_0$, and exposing of the photosensitive member to an optical image of the original is initiated. Thereafter, after lapse of the predetermined time Tc following the production of the detection signal by the switch 51, the register rollers 18, 18 are actuated and deliver the transfer-printing sheet, which has been standing by, to the transfer-printing position.

In the third embodiment described above, one detection means is relied on to effect lighting of the light source, passing of a current to the electrical charging device, and feeding and delivery of a copy sheet in good timing, as in the first embodiment. Thus the same trouble as has been described with reference to the first embodiment may be encountered. In order to obviate this trouble, the second detection switch means for detecting the insertion of an original may be mounted upstream of the original leading end detection switch as is the case with the second embodiment, as a fourth embodiment of the invention, so that an original insertion detection signal produced by the second detection switch means can be used for lighting the light source 6, supplying a current to the electrical charging device 12 and actuating the feed roller 23 of either one of the cassettes 22.

In summary, the invention comprises an improvement in a copy machine for forming a copy from a copy sheet such as photosensitive copy sheet 25 in FIG. 3 or transfer printing sheets from cassettes 22 in FIG. 1 from an original such as a sheet 5 or a book 32, at various magnification ratios. The copy machine includes exposure means exemplified by light 6, mirrors 7, 8 and 9, lens 10, and photosensitive drum 11 with its associated parts in FIG. 1 or similar exposure means associated with the embodiment of FIG. 2 for making copies from photosensitive copy sheets 25 which are of a known structure. The copy machine further includes original feed means for either moving the original in relationship to the exposure means or conversely for moving the exposure means in relationship to a stationary original, such original feed means are exemplified by 3*a* in FIG. 1 or the prior mentioned means for moving the light source 6 with mirror 7 in respect to an original support glass 2 of conventional structure. Copy sheet feed means are also provided which are exemplified by rollers 23 and 18 in FIG. 1, or rollers 27 in FIG. 3. The copy machine also includes magnification means which are required for changing the orientation of the exposure means and the speed of the copy sheet feed means to accommodate changes in the magnification ratio between the image on an original and the image on a copy sheet. The improvement functions to register or coordinate the feeding of a forward end or edge of an original with the front end or edge of a copy sheet regardless of the change in the magnification ratio by providing a first detection means exemplified by switches 29*a*, *b*, and *c* in FIG. 4 and the three positions of switch 30 in FIG. 5. One of the switches 29*a*, *b* or *c* or the location of the switch 30 is selected in accordance with the magnification ratio and effects a proper registration of the original with respect to the copy sheet. A second detection means exemplified by 44 in FIG. 8 may be provided for activating the exposure means which may include light source 6 and charging device 12 so that these elements are in a functional orientation before the activation of the original feed means and the copy sheet feed means. Third detection means exemplified by cam 50 and switch 51 in FIG. 11 may further be provided when a photosensitive element such as a photosensitive drum 11 includes a gap 11*a*. Such means are utilized so that a copy sheet from feed means 17 is not provided to the photosensitive drum 11 when gap 11*a* is being presented. The aforementioned detection means may all supply impulses for effecting the activation of the various structure as aforementioned to effect the proper registration and orientation of the various elements in the copy machine.

While preferred embodiments of this invention are shown and described hereinabove, it will be understood, that the invention is not to be limited thereto, since many modifications and changes may be made therein, and it is contemplated therefore, by the appended claims, to cover any such modifications as fall within the true sprit and scope of this invention.

What is claimed is:

1. A method for effecting registration for a copying apparatus having a magnification ratio varying device, in which a photosensitive member in motion is exposed to an optical image of an original by slit exposing to form an electrostatic latent image thereon, by varying the original scanning velocity in accordance with the magnification ratio selected, such method comprising:

providing first detection means for detecting the leading end of the original in a path of travel of the original, said first detection means having its detecting position varied in accordance with the magnification ratio selected; and delivering a copy sheet simultaneously as or after lapse of a predetermined time following the production of a detection signal by said first detection means;

providing second detection means upstream of said first detection means in said path of travel of the original; and performing various operations necessary for effecting electrophotographic copying, including feeding of a copy sheet, lighting of a light source, charging of an electrical charging device, etc., by using a detection signal produced by said second detection means.

2. A method for effecting registration as claimed in claim 1, wherein said first detection means comprises a plurality of detection switches equal in number to the magnification ratios among which one magnification ratio can be selected, and said detection switches are arranged in positions corresponding to the respective magnification ratios whereby the corresponding detection switch can be selectively actuated in accordance with the magnification ratio selected.

3. A method for effecting registration as claimed in claim 1, wherein said first detection means comprises one detection switch, and said one detection switch can be moved to one of a plurality of positions corresponding to the magnification ratio selected.

4. A method for effecting registration as claimed in claim 3, wherein said first detection means is located in a position in which a signal produced by said first detection means can be used as a transfer-printing sheet delivery signal.

5. A method for effecting registration as claimed in claim 1, wherein said first detection means is located in a position in which a signal produced by said first detection means can be used as a transfer-printing sheet delivery signal.

6. A method for effecting registration for a copying apparatus having a magnification ratio varying device, in which a photosensitive member in motion is exposed in a substantially constant position to an optical image of an original by slit exposing to form an electrostatic latent image thereon, by varying the original scanning velocity in accordance with the magnification ratio selected, such method comprising:

providing first detection means for detecting the leading end of the original in a path of travel of the original, providing further detection means for detecting the reference position of said photosensitive member in motion;

temporarily stopping the movement of the original after lapse of a predetermined time following the production of a detection signal by said first detection means and before exposing of the photosensitive member to the original is performed, the position in which said original is temporarily stopped by said first detection means varying depending on the magnification ratio selected;

delivering a transfer-printing sheet after lapse of a predetermined time following the production of a detection signal by said further detection means; and restarting the travel of said stationary original after lapse of another predetermined time following the production of said detection signal by said further detection means, whereby the photosensitive member can be exposed to the original.

7. A method for effecting registration as claimed in claim 6, wherein said first detection means comprises a plurality of detection switches equal in number to the magnification ratios among which one magnification ratio can be selected, and said detection switches are arranged in positions corresponding to the respective magnification ratios whereby the corresponding detection switch can be selectively actuated in accordance with the magnification ratio selected.

8. A method for effecting registration as claimed in claim 6, wherein said first detection means comprises one detection switch, and said one detection switch can be moved to one of a plurality of positions corresponding to the magnification ratio selected.

9. A method for effecting registration as claimed in claim 6, wherein said first detection means is located in a position in which a signal produced by said first detection means can be used as a transfer-printing sheet delivery signal.

10. A method for effecting registration for a copying apparatus having a magnification ratio varying device, in which a photosensitive member in motion is exposed in a substantially constant position to an optical image of an original by slit exposing to form an electrostatic latent image thereon, by varying the original scanning velocity in accordance with the magnification ratio selected; such method comprising:

providing first detection means for detecting the leading end of the original in a path of travel of the original;

providing second detection means upstream of said first detection means in said path of travel of the original;

providing third detection means for detecting the reference position of said photosensitive member in motion; temporarily stopping the movement of the original after lapse of a predetermined time following the production of a detection signal by said second detection means and before exposing the photosensitive member to the original;

performing feeding of a transfer-printing sheet, lighting of an exposing light source and actuation of a charging device by means at least one of said detection signal produced by said second detection means and a detection signal produced by said third detection means;

restarting the travel of said stationary original after lapse of a predetermined time following the production of said detection signal by said third detection means so as to expose the photosensitive member to the original; and delivering for effecting registration of the transfer-printing sheet, which has been fed, after lapse of a predetermined time following the detection of the restarted original by said first detection means, said first detection means having its detecting position varied in accordance with the magnification ratio selected.

11. A method for effecting registration as claimed in claim 10, wherein said first detection means comprises a plurality of detection switches equal in number to the magnification ratios among which one magnification ratio can be selected, and said detection switches are arranged in positions corresponding to the respective magnification ratios whereby the corresponding detection switch can be selectively actuated in accordance with the magnification ratio selected.

12. A method for effecting registration as claimed in claim 10, wherein said first detection means comprises one detection switch, and said one detection switch can be moved to one of a plurality of positions corresponding to the magnification ratio selected.

13. A method for effecting registration as claimed in claim 10, wherein said first detection means is located in a position in which a signal produced by said first detection means can be used as a transfer-printing sheet delivery signal.

14. A method for effecting registration for a copying apparatus having a magnification ratio varying device, in which a photosensitive member in motion is exposed in a substantially constant position to an optical image of an original by slit exposing to form an electrostatic latent image thereon, by varying the original scanning velocity in accordance with the magnification ratio selected, such method comprising:

providing first detection means for detecting the leading end of the original in a path of travel of a movable optical system;

providing further detection means for detecting the reference position of said photosensitive member in motion;

temporarily stopping the movement of the optical system after elapse of a predetermined time following the production of a detection signal by said first detection means and before exposing of the photosensitive member to the original is performed, the position in which said optical system is temporarily stopped by said first detection means varying depending on the magnification ratio selected;

delivering a transfer-printing sheet after elapse of a predetermined time following the production of a detection signal by said further detection means; and restarting the travel of said stationary optical system after elapse of another predetermined time following the production of said detection signal by said further detection means, whereby the photosensitive member can be exposed to the original.

15. A method for effecting registration for a copying apparatus having a magnification ratio varying device, in which a photosensitive member in motion is exposed in a substantially constant position to an optical image of an original by slit exposing to form an electrostatic latent image thereon, by varying the original scanning velocity in accordance with the magnification ratio selected; such method comprising:

providing first detection means for detecting the leading end of the original in a path of travel of a movable optical system;

providing second detection means upstream of said first detection means in said path of travel of said optical system;

providing third detection means for detecting the reference position of said photosensitive member in motion;

temporarily stopping the movement of said optical system after a lapse of a predetermined time following the production of a detection signal by said second detection means and before exposing the photosensitive member to the original;

performing feeding of a transfer-printing sheet, lighting of an exposing light source and actuation of a charging device by means of at least one of said detection signals produced by said second detection means and a detection signal produced by said third detection means;

restarting the travel of said stationary optical system after a lapse of a predetermined time following the production of said detection signal by said third detection means so as to expose the photosensitive member to the original; and delivering the transfer-printing sheet for effecting registration, said sheet having been fed, after the lapse of a predetermined time following the detection of the restarted optical system by said first detection means, said first detection means having its detecting position varied in accordance with the magnification ratio selected.

16. In a copy machine for forming a copy on a copy sheet from an original at various magnification ratios having exposure means for exposing the copy sheet with an image from the original, original feed means for moving the original and the exposure means in relationship to each other, copy sheet feed means for feeding a copy sheet to the exposure means, and magnification means for varying the magnification ratio between the original and the copy sheet, the improvement comprising a device for effecting registration between the forward edge of the original and the forward edge of a copy sheet comprising, first detection means associated with said original and copy sheet feed means for sensing the forward edge of the original and producing an impulse at a selected time thereafter for activating said copy sheet feed means, the position of said first detection means being variable in accordance with the magnification ratio, wherein the copy machine includes a rotatable photoconductive member having a photoconductive surface with a non-photoconductive gap, said improvement further comprising additional detection means connected between said photoconductive member and said copy sheet feed means for delaying the activation of said copy sheet feed means by said first detection means as said gap passes said copy sheet feed means.

17. A method for effecting registration for a copying apparatus having a magnification ratio varying device, in which a photosensitive member in motion is exposed to an optical image of an original by slit exposing to form an electrostatic latent image thereon, by varying the original scanning velocity in accordance with the magnification ratio selected, such method comprising:

providing first detection means for detecting the leading end of the original in a path of travel of a movable optical system, said first detection means having detecting position varied in accordance with the magnification ratio selected; and delivering a copy sheet simultaneously as or after lapse of a predetermined time following the production of a detection signal by said first detection means, providing second detection means upstream of said first detection means in said path of travel of the movable optical system; and performing various operations necessary for effecting electrophotographic copying, including feeding of a copy sheet, lighting of a light source, charging of an electrical charging device, etc., by using a detection signal produced by said second detection means.

* * * * *